US011054125B1

(12) United States Patent
Chen

(10) Patent No.: US 11,054,125 B1
(45) Date of Patent: Jul. 6, 2021

(54) LED MODULE LIGHTING SIGNAGE ELECTRICAL POWER AND DATA DISTRIBUTION AND CONNECTION SYSTEM

(71) Applicant: Sikai Chen, Delran, NJ (US)

(72) Inventor: Sikai Chen, Delran, NJ (US)

( * ) Notice: Subject to any disclaimer, the term of this patent is extended or adjusted under 35 U.S.C. 154(b) by 0 days.

(21) Appl. No.: 16/946,601

(22) Filed: Jun. 29, 2020

Related U.S. Application Data

(60) Provisional application No. 63/030,422, filed on May 27, 2020, provisional application No. 63/034,799, filed on Jun. 4, 2020.

(51) Int. Cl.

| | |
|---|---|
| ***F21V 23/06*** | (2006.01) |
| ***H01R 13/627*** | (2006.01) |
| ***H01R 31/06*** | (2006.01) |
| ***H01R 31/02*** | (2006.01) |
| ***H01R 24/28*** | (2011.01) |
| ***F21S 4/10*** | (2016.01) |
| ***F21V 23/00*** | (2015.01) |
| *G09F 13/22* | (2006.01) |
| *H01R 103/00* | (2006.01) |
| *F21Y 115/10* | (2016.01) |

(52) U.S. Cl.
CPC ..... *F21V 23/06* (2013.01); *F21S 4/10* (2016.01); *F21V 23/008* (2013.01); *H01R 13/6273* (2013.01); *H01R 24/28* (2013.01); *H01R 31/02* (2013.01); *H01R 31/06* (2013.01); *F21Y 2115/10* (2016.08); *G09F 13/22* (2013.01); *G09F 2013/222* (2013.01); *H01R 2103/00* (2013.01)

(58) Field of Classification Search
CPC ... H01R 13/6273; F21V 23/06; F21V 23/008; F21S 4/10
See application file for complete search history.

(56) References Cited

U.S. PATENT DOCUMENTS

| | | | | |
|---|---|---|---|---|
| 5,080,603 | A * | 1/1992 | Mouissie ..... | H01R 13/6273 439/353 |
| 2008/0084695 | A1* | 4/2008 | Hsu ..... | F21S 4/10 362/249.01 |
| 2011/0310628 | A1* | 12/2011 | Mostoller ..... | H05B 45/00 362/458 |

(Continued)

*Primary Examiner* — Bryon T Gyllstrom
*Assistant Examiner* — Christopher E Dunay
(74) *Attorney, Agent, or Firm* — Stuart M. Goldstein

(57) ABSTRACT

An LED module lighting signage system receives electricity from a power supply as well as data from a data processor source, via electrical power and data supply wiring, at least one power/data distributor, and quick connect, plug-in male and female connectors. The distributor has multiple ports which permit wiring to run from a power supply and data processor source to the distributor and from the distributor to multiple LED modules and fixtures, e.g. different channel letters, LED stringlights, etc. All connections between the power source, data processor source, electrical power/data distributor, and the modules or fixtures are accomplished easily by means of male to female quick connect plug-in connectors. In this manner, the power/data distributor can provide electrical power to LED module lighting signage and also transmit data from a data processor source to the signage in a single cohesive system.

11 Claims, 6 Drawing Sheets

(56) References Cited

U.S. PATENT DOCUMENTS

| | | | | |
|---|---|---|---|---|
| 2015/0102731 | A1* | 4/2015 | Altamura | F21V 23/0478<br>315/152 |
| 2015/0159844 | A1* | 6/2015 | Flaherty | F21S 4/10<br>362/231 |
| 2015/0192285 | A1* | 7/2015 | Chen | H05B 45/40<br>315/185 R |
| 2020/0120770 | A1* | 4/2020 | Huang | H05B 45/44 |
| 2020/0144762 | A1* | 5/2020 | Kim | H01R 13/5202 |

* cited by examiner

LED MODULE LIGHTING SIGNAGE ELECTRICAL POWER AND DATA DISTRIBUTION AND CONNECTION SYSTEM

RELATED APPLICATIONS

This application is related to and claims the benefit of provisional application Ser. No. 63/030422, filed on May 27, 2020 and provisional application Ser. No. 63/034799, filed on Jun. 4, 2020.

FIELD OF THE INVENTION

The present invention relates to the supply, connection, and distribution of electrical power and informational data to lighted, LED module and like signage.

BACKGROUND OF THE INVENTION

LED modules are advantageously used where flexible, signage installations, especially those requiring curves and corners, are required. Such modules are found, for example, in LED stringlighting, sign channel lettering fixtures, and in window displays. The modules provide their illumination from a supply of electricity via wiring and wire connections. Most individual signage units comprising multiple modules require separate, individual, electrical power sources and wiring with stripped wire ends and wire connector nuts. Installing these systems is often difficult, at the very least inconvenient, and time consuming, especially for large projects. In addition, operating these separate systems is inefficient and uneconomical. There are currently no lighted, LED module signage systems which provide the illumination benefits of LED and similar lighting systems, but still allow for quick and ready installation, connection, and maintenance, utilizing a single power source for economical operation.

The input of informational data to lighted signage is also sometimes required to provide relevant operational instruction to the signage system. Towards this end, in addition to providing quick connection of electrical power from a single power source, such connections must be capable of transmitting data in a similar fashion in one simple, compact system.

SUMMARY OF THE INVENTION

It is thus the object of the present invention to provide a lighted signage electrical power and informational data distribution system which can be quickly and easily connected and installed, and which effectively, efficiently, and economically operates to electrically power and transmit data to a multitude of individual modules which make up a signage fixture.

These and other objects are accomplished by the present invention, an LED module lighting system which comprises at least one electrical power/data distributor which is capable of receiving electricity from a power supply as well as data from a data processor source, via electrical power and data supply wiring and quick connect, plug-in male and female or like connectors. The power/data distributor has multiple ports which permit wiring to run from a power supply and data processor source to the distributor and from the distributor to multiple LED modules and fixtures, e.g. different channel letters, LED stringlights, etc. All connections between the power source, data processor source, electrical power/data distributor, and the modules or fixtures are accomplished easily and simply by means of male to female quick connect plug-in connectors, for ease of installation and maintenance. In this manner, the power/data distributor can both distribute and provide electrical power to LED module lighting signage and also transmit data from a data processor source to the signage in a single cohesive system.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 1:
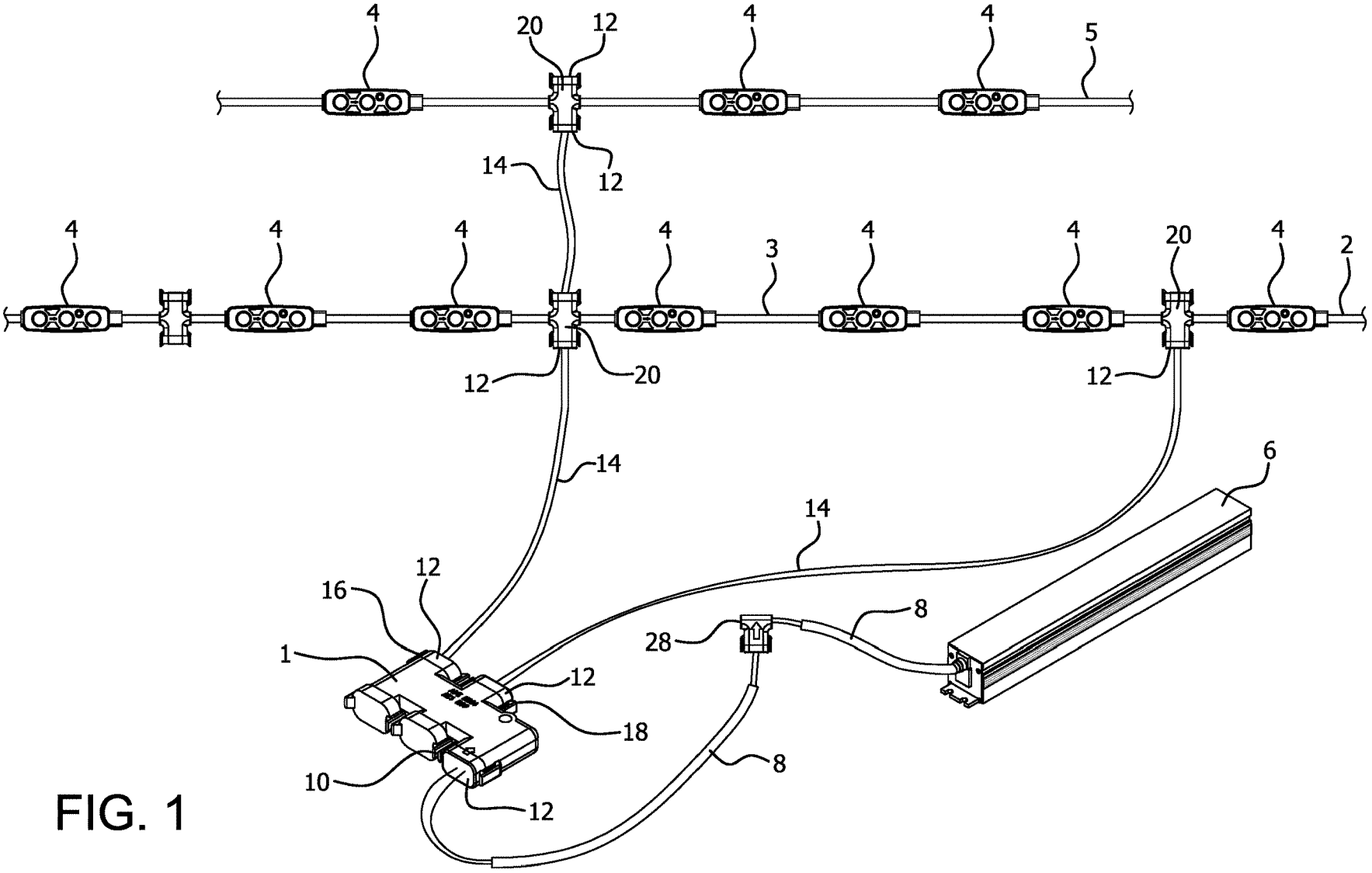
FIG. 1 illustrates an example of the configuration of the relevant section of the lighted signage electrical power and data distribution system of the present invention in which only electrical power is supplied to LED modules.

FIG. 1 illustrates the use of electrical/data distributor 1 in providing solely electrical power to LED module stringline 2 comprising LED modules 4 connected to stringline wiring 3. Stringline 2 can be used as a single lighting component or as one of many similar stringline components in an integrated signage fixture. Electrical power supply 6 provides electricity via electrical wiring 8 and quick plug-in female connector 28 to inlet port 10 of distributor 1 utilizing quick plug-in male connector 12 into which the wiring is integrated. Outlet electrical wiring 14 is integrated into and extends from male connectors 12 plugged into outlet ports 16 and 18 of distributor 1. The other ends of wiring 14 are integrated into the ends of male connectors 12 which are plugged into quick plug-in female connectors 20 through which stringline wiring 3 extends. Outlet electrical wiring 14 extends from female connector 20 in stringline 2 to separate stringline 5 where it is integrated into male connector 12. The male connector is plugged into female connector 20 to provide electrical power to modules 4 in stringline 5. Module illumination is thus accomplished utilizing the distribution of electricity, to a variety of different circuit configurations, through distributor 1, quick-plug in connectors 12 and 20, and associated wiring.

Figure 2:
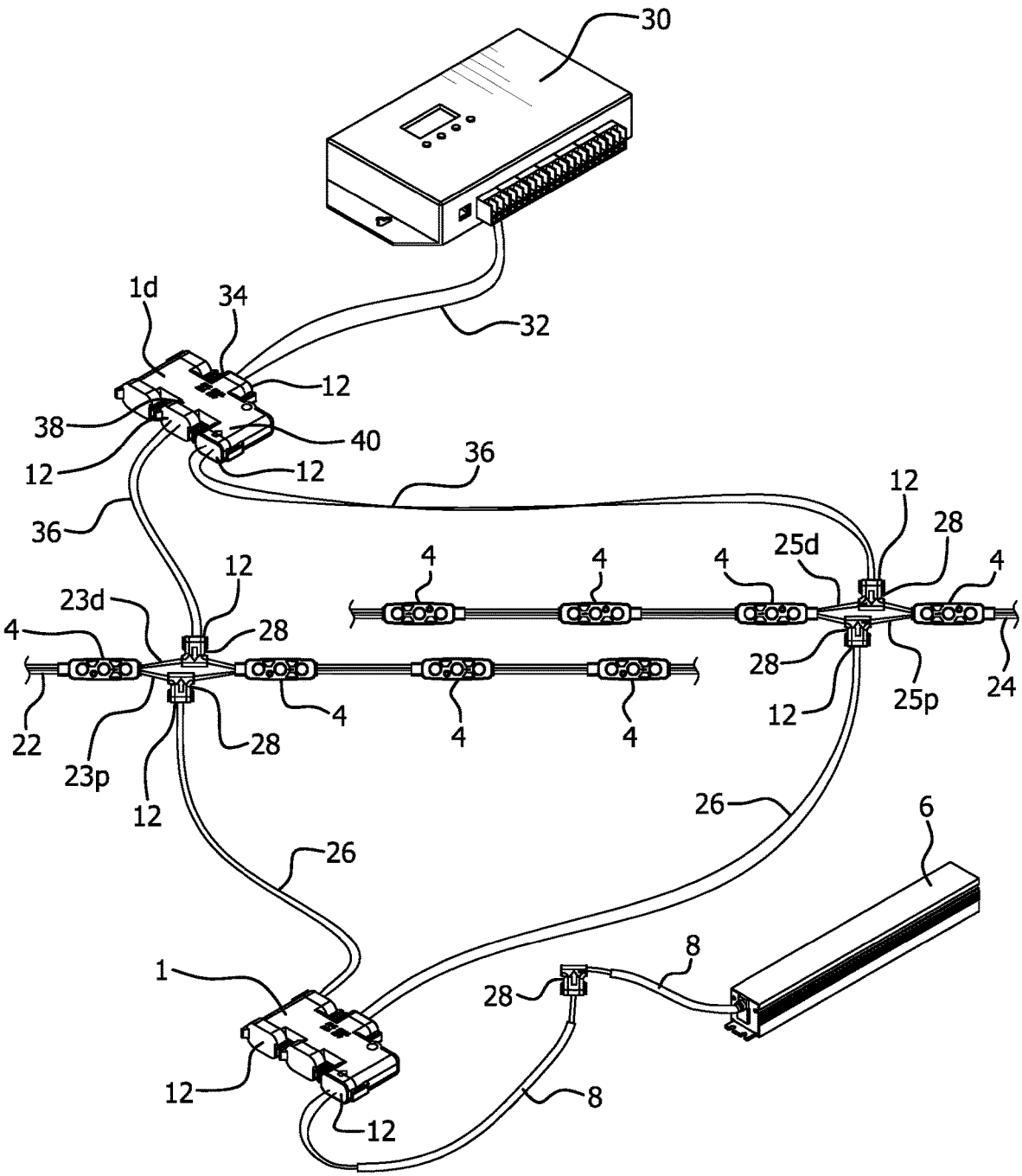
FIG. 2 illustrates an example of the configuration of the relevant section of the lighted signage electrical power and data distribution system of the present invention in which two power/data distributors are used to provide electrical power and informational data to LED modules.

FIG. 2 illustrates the use of two electrical power/data distributors 1 and 1*a* in a single lightage system to provide both electrical power and informational data. In this system configuration, power supply 6 provides electricity to distributor 1 via electrical wiring 8, in the same manner as previously described with regard to FIG. 1. Distributor 1 then provides electrical power to the LED modules 4 in stringlines 22 and 24, comprising stringline wiring 23*p* and 25*p*, via outlet electrical wiring 26 integrated into male connectors 12, which are plugged into quick plug-in female connectors 28. Stringline wiring 23*p* and 25*p* extends through female connectors 28.

Distributor 1*d* transmits data from processor source 30 by receiving data over wiring 32 and then transmitting the data directly to stringlines 22 and 24. Data wiring 32 runs from processor source 30 and is connected by quick plug-in male connector 12 to inlet port 34 of distributor 1*d*. The ends of data wiring 36 are plugged into outlet ports 38 and 40 of distributor 1*d* by male connectors 12 and, at their other ends, male connectors 12 are plugged into female connectors 28, into which stringline wiring 23*d* and 25*d* extend and are integrated.

In this configuration, using two distributors, both electrical power and informational data are transmitted directly to each modular stringline, providing uninterrupted electricity and strong, clear informational data signals.

The quick, plug-in connectors utilized in the systems described herein provide both ease of installation and versatility in configuring such systems.

Figure 3:
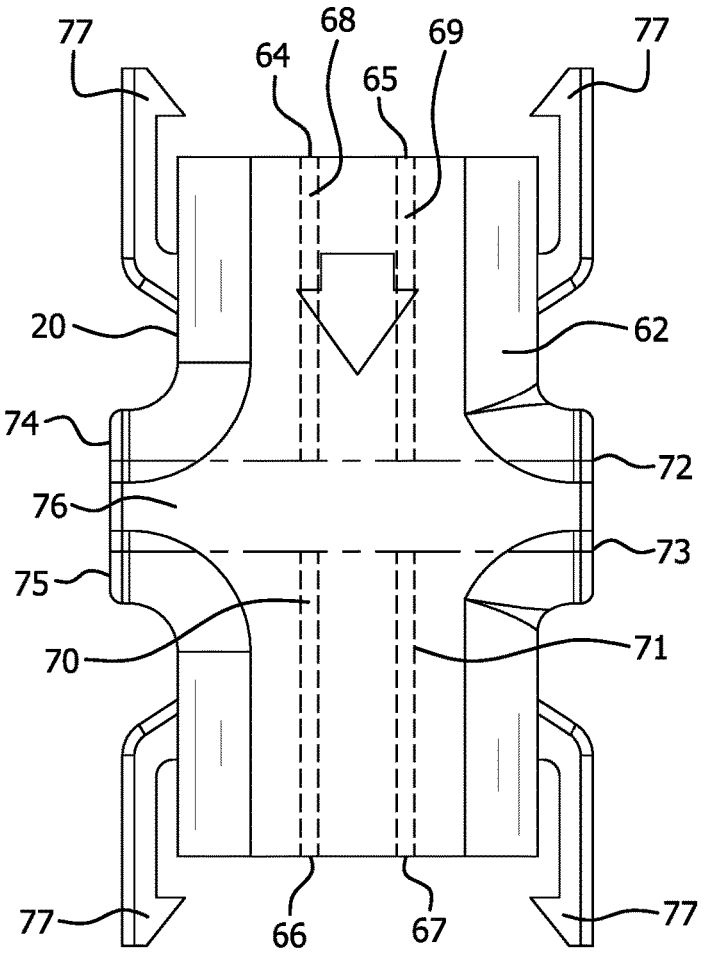
FIG. 3 is a top view of the female connector of the present invention.
Figure 4:
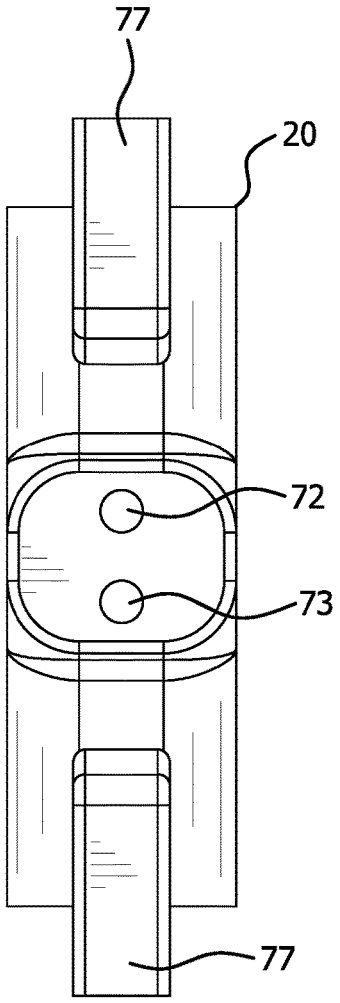
FIG. 4 is an elevation view of the female connector of the present invention.
Figure 5:
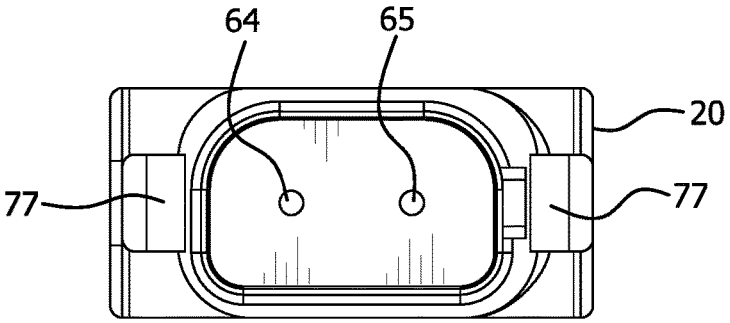
FIG. 5 is an end view of the female connector of the present invention.

FIGS. 3-5 show quick plug-in female connector 20 in detail. This connector comprises main body 62 with top and bottom plug-in ports 64, 65, 66, and 67, configured to accept plugs from male connector 12. Channels 68, 69, 70, and 71 maintain the male connector plugs within female connector 20. Electrical and data wiring is configured to extend into, through, and be housed in passageway 76 within female connector 20. Lateral passage openings 72, 73, 74, and 75 in main body 62 allow access to passageway 76. Attachment clips 77 ensure for a secure connection with male connector 12.

Figure 6:
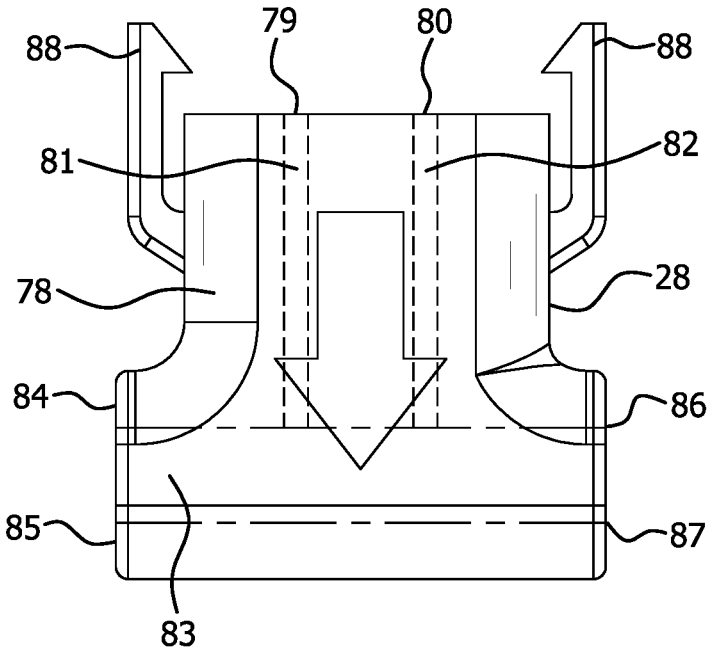
FIG. 6 is a top view of the second female connector of the present invention.
Figure 7:
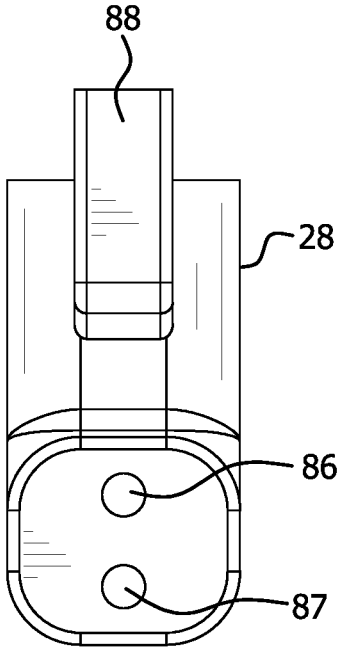
FIG. 7 is an elevation view of the second female connector of the present invention.
Figure 8:
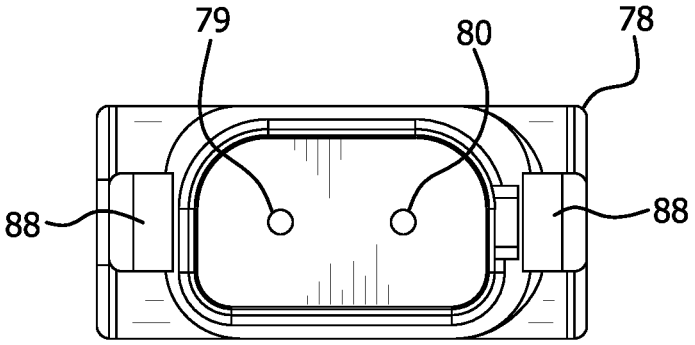
FIG. 8 is an end view of the second female connector of the present invention.

FIGS. 6-8 show quick plug-in female connector 28 comprising main body 78 with plug-in ports 79 and 80 configured to accept plugs from male connector 12. Channels 81 and 82 maintain the male connector plugs within female connector 28. Electric and data wiring is configured to extend into, through, and be housed in passageway 83 within female connector 28. Lateral openings 84, 85, 86, and 87 in main body 78 allow access to passageway 83. Attachment clips 88 ensure for a secure connection with male connector 12.

Figure 9:
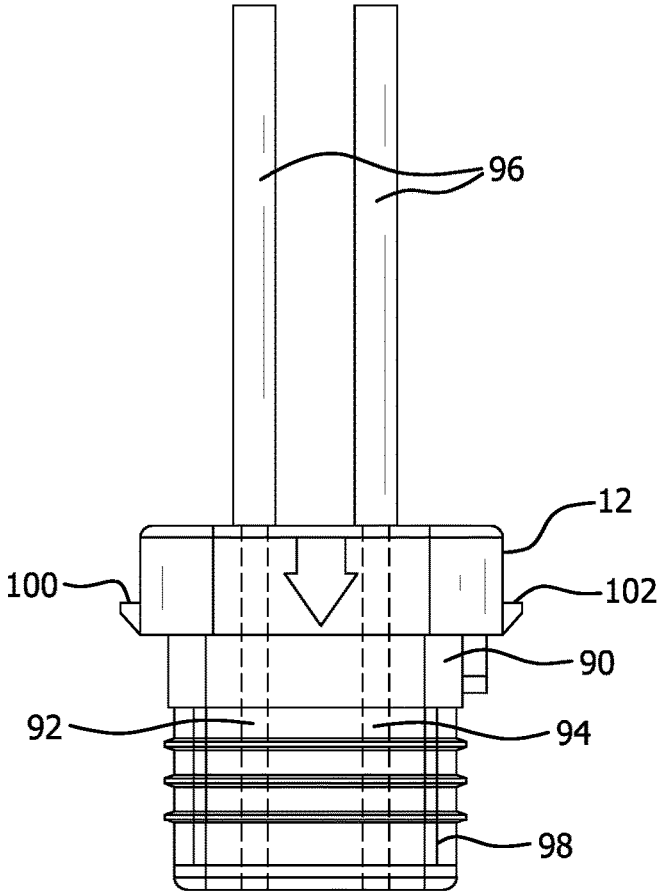
FIG. 9 is a top view of the male connector of the present invention.
Figure 10:
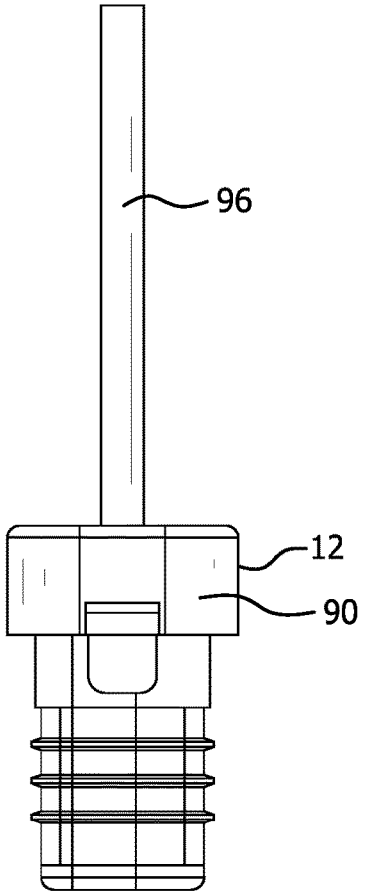
FIG. 10 is an elevation view of the male connector of the present invention.
Figure 11:
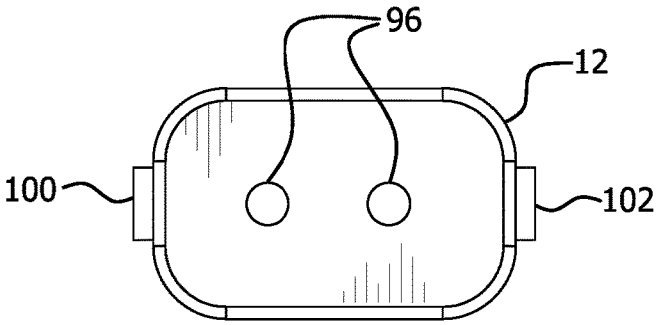
FIG. 11 is an end view of the male connector of the present invention.

FIGS. 9-11 show quick plug-in male connector 12 comprising main body 90 with electrical plugs 92 and 94 which extend the length of the main body. Electric and/or data wiring 96 from system components is permanently integrated with and connected to plugs 92 and 94. Flexible, waterproof covering 98 circumscribes the plugs. Tab members 100 and 102 are configured to snap onto attachment clips 58 of distributor 1 and attachment clips 77 and 88 of female connectors 20 and 28 to interconnect and guarantee a secure connection.

Figure 13:
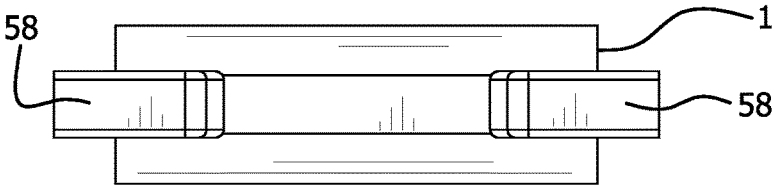
FIG. 13 is a front view of the power/data distributor of the present invention.
Figure 12:
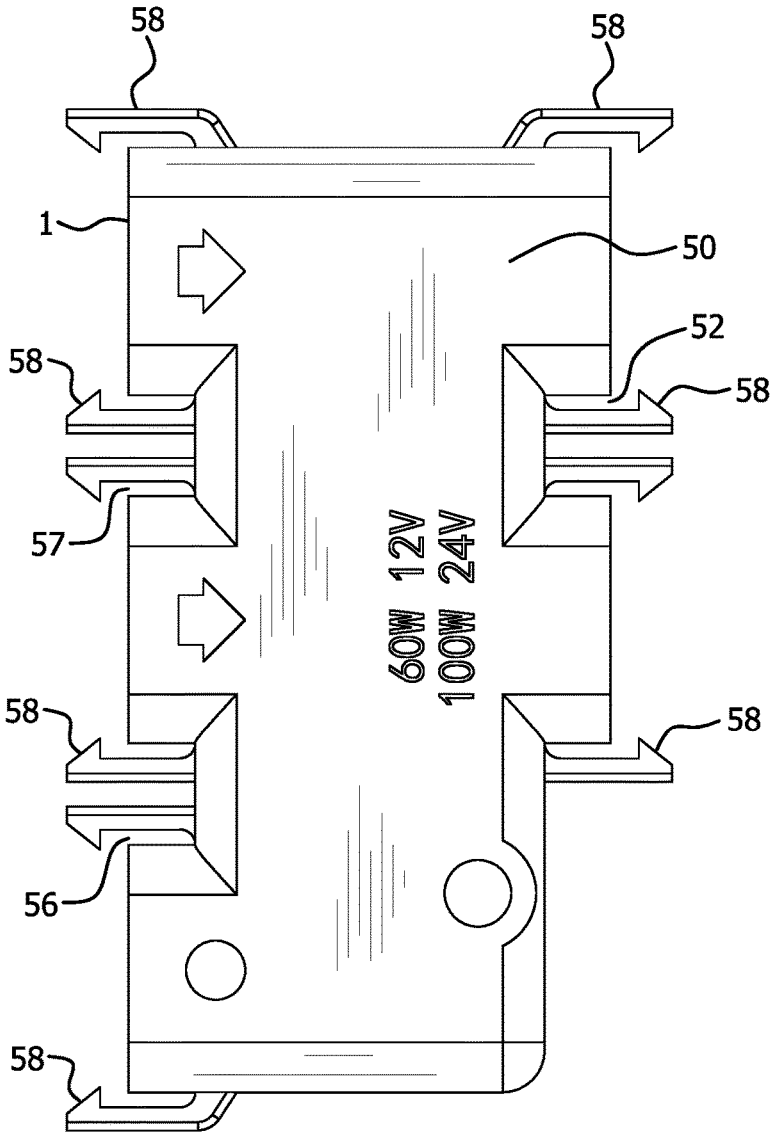
FIG. 12 is a top view of the power/data distributor of the present invention.
Figure 14:
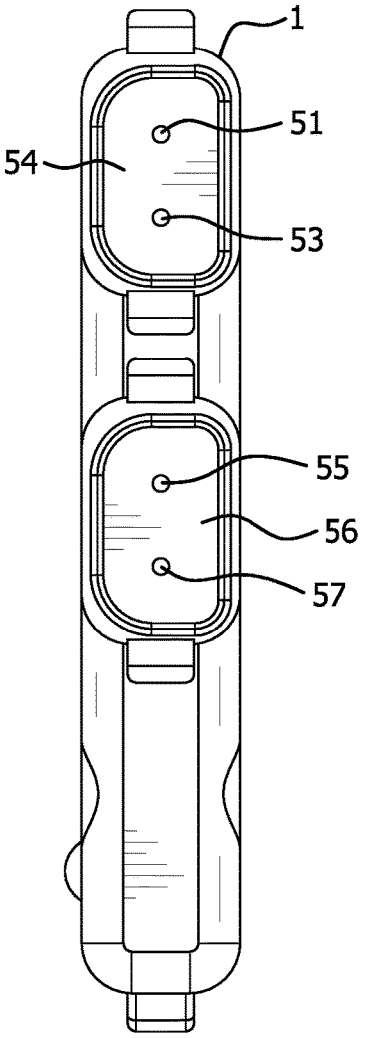
FIG. 14 is an elevation view of the power/data distributor of the present invention.

Electrical power/data distributor 1 is shown in FIGS. 12-14. Casing 50 houses electrical and data transmitting contacts which are configured to connect with quick plug-in male connector 12 via ports 52, 54, and 56. Plug-in ports 51, 53, 55, and 57 are configured to accept plugs from male connector 12. Attachment clips 58 ensure for a secure connector between distributor 1 and male connector 12.

While the use of the quick, plug-in connectors described herein is preferred, other electrical and data connection means are contemplated, e.g. stripped wire connectors, soldered connections, etc.

The systems described herein are unique to the LED module lighting industry, but are not to be restricted to the configurations disclosed. Electric and data circuitry can be constructed in a variety of configurations, especially given the versatility afforded by the quick plug-in connectors of the present invention.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. An LED module lighting system having a plurality of LED modules, said system comprising:

a power supply for providing electrical power to the LED module lighting system;

a processor source for providing informational data to the LED module lighting system;

a first, independent, standalone, electrical power and data distributor having an input port and two output ports;

electrical input wiring divorced from and unattached to the processor source, but extending from the power supply to the input port of the first distributor, and electrical output wiring extending directly from the two output ports of the first distributor to the LED modules, the input and output wiring supplying only electrical power to the LED modules from the power source;

a second, independent, standalone, electrical power and data distributor having an input port and two output ports;

data input wiring extending from the processor source to the input port of the second distributor, and data output wiring extending from the two output ports of the second distributor to the LED modules, the data input and output wiring supplying only informational data to the LED modules from the processor source; and connector means for attaching the electrical and data wiring between the power source and the first distributor, between the first distributor and the LED modules, between the processor source and the second distributor, and between the second distributor and the LED modules, wherein electrical power is provided solely by means of a distinct electrical circuit from the power supply to the first distributor which transmits the electrical power to the LED modules, and informational data is provided solely by means of a second distinct informational data circuit from the processor source to the second distributor which transmits the informational data to the LED modules.

2. The LED module lighting system as in claim 1 wherein the first distributor provides electrical power to multiple LED modules in LED stringlights.

3. The LED module lighting system as in claim 2 wherein the second distributor provides informational data to multiple LED modules in LED stringlights.

4. The LED module lighting system as in claim 1 wherein the second distributor provides informational data to multiple LED modules in LED stringlights.

5. The LED module lighting system as in claim 1 wherein the connector means comprises quick plug-in female and male connectors.

6. The LED module lighting system as in claim 5 wherein the female connector comprises a main body with a through passageway configured to house electrical and data wiring which extends through the passageway, said main body having plug-in channels configured to maintain the male connector within the female connector.

7. The LED module lighting system as in claim 6 wherein the male connector comprises a main body with plugs extending the length of the main body, said plugs being configured to extend into the plug-in channels of the female connector.

8. The LED module lighting system as in claim 5 wherein the male connector comprises a main body with plugs extending the length of the main body, said plugs being configured to extend into the female connector.

9. The LED module lighting system as in claim 8 wherein the female connector comprises a main body with a through passageway configured to house electrical and data wiring which extends through the passageway, said main body having plug-in channels configured to maintain the male connector within the female connector.

10. The LED module lighting system as in claim 5 wherein the female and male connectors comprise means to secure the connectors together.

11. The LED module lighting system as in claim 10 wherein the means to secure the connectors together comprise female connector attachment clips and male connector tab members.

* * * * *